US008464403B2

(12) United States Patent
Fiedler

(10) Patent No.: US 8,464,403 B2
(45) Date of Patent: Jun. 18, 2013

(54) SHIELDED MAGNETIC PLUG-IN LOCK

(75) Inventor: Joachim Fiedler, Hannover (DE)

(73) Assignee: Fidlock GmbH, Hanover (DE)

( * ) Notice: Subject to any disclaimer, the term of this patent is extended or adjusted under 35 U.S.C. 154(b) by 189 days.

(21) Appl. No.: 13/003,825

(22) PCT Filed: Jul. 17, 2009

(86) PCT No.: PCT/DE2009/001007

§ 371 (c)(1),
(2), (4) Date: Feb. 23, 2011

(87) PCT Pub. No.: WO2010/006594

PCT Pub. Date: Jan. 21, 2010

(65) Prior Publication Data

US 2011/0138583 A1 Jun. 16, 2011

(30) Foreign Application Priority Data

Jul. 17, 2008 (DE) ..... 10 2008 033 546

(51) Int. Cl.
*A44B 11/25* (2006.01)
*A44B 99/00* (2010.01)

(52) U.S. Cl.
USPC ..... 24/303; 24/586.11; 24/614; 24/662; 24/702

(58) Field of Classification Search
USPC ..... 24/303, 586.1, 586.11, 587.12, 589.1, 24/614, 615, 625, 669, 662, 671, 702, 66.1; 248/206.5; 292/251.2; 63/29.2, 900
See application file for complete search history.

(56) References Cited

U.S. PATENT DOCUMENTS

| | | | | |
|---|---|---|---|---|
| 2,615,227 | A * | 10/1952 | Hornik | 24/303 |
| 3,293,714 | A * | 12/1966 | Shafer | 24/303 |
| 5,664,298 | A | 9/1997 | Nessar-Ivanovic | |
| 7,073,232 | B1 | 7/2006 | Fuhrman et al. | |
| 2008/0006354 | A1 | 1/2008 | Lang | |
| 2010/0287741 | A1 | 11/2010 | Fiedler | |
| 2010/0325844 | A1 * | 12/2010 | Fiedler | 24/303 |

FOREIGN PATENT DOCUMENTS

| | | | |
|---|---|---|---|
| CN | 1216904 | A | 5/1999 |
| WO | 2008006354 | A2 | 1/2008 |
| WO | 2008006355 | A2 | 1/2008 |
| WO | WO 2008006357 | A2 * | 1/2008 |
| WO | 2009006888 | A2 | 1/2009 |
| WO | 2009103279 | A2 | 8/2009 |

* cited by examiner

*Primary Examiner* — James Brittain
(74) *Attorney, Agent, or Firm* — The Webb Law Firm

(57) ABSTRACT

A shielded magnetic plug-in lock, for which a connector is plugged into a connector receiving element and held therein by magnetic holding forces or additionally by means of mechanical engagement, is provided. The connector and the connector receiving element are designed in such a way that the connector magnet and the magnet for the connector receiving element are magnetized transversely to the closing direction X, and at least one shielding plate consisting of a ferro-magnetic material is provided on the plug or the plug receiving element. The shielding plate covers the connector magnet and the connector receiving element magnets, and the ferro-magnetic material and the thickness of the shielding plate are selected in such a way as to obtain a magnetic shielding sufficient for a pre-determined use.

4 Claims, 19 Drawing Sheets

Fig. 2b
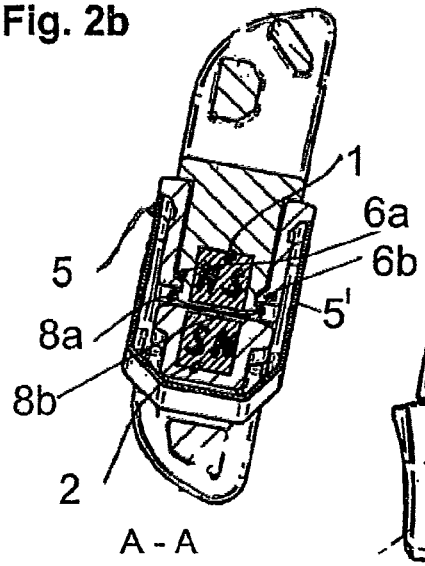
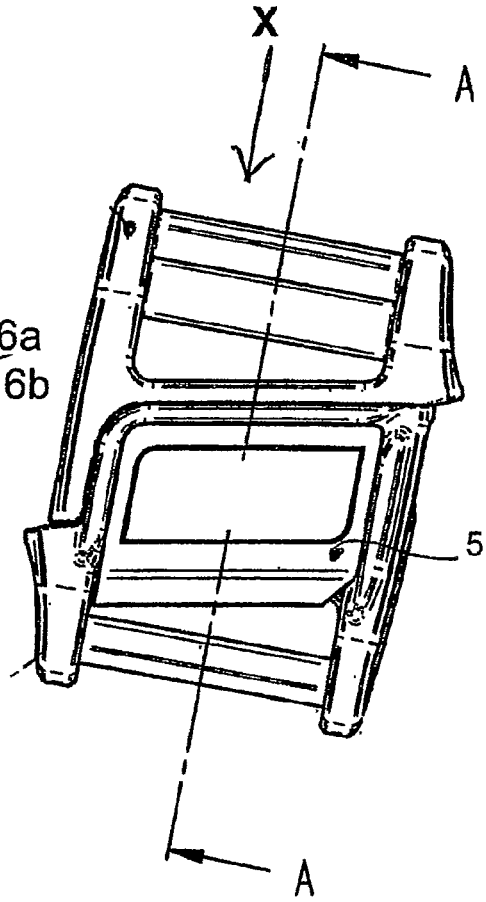
Fig. 2a

Comparative Example

Prior art

X
3
1
5a
6b
5
8b
5a'
6a
5'
8a
2
4
A - A

A
A
5

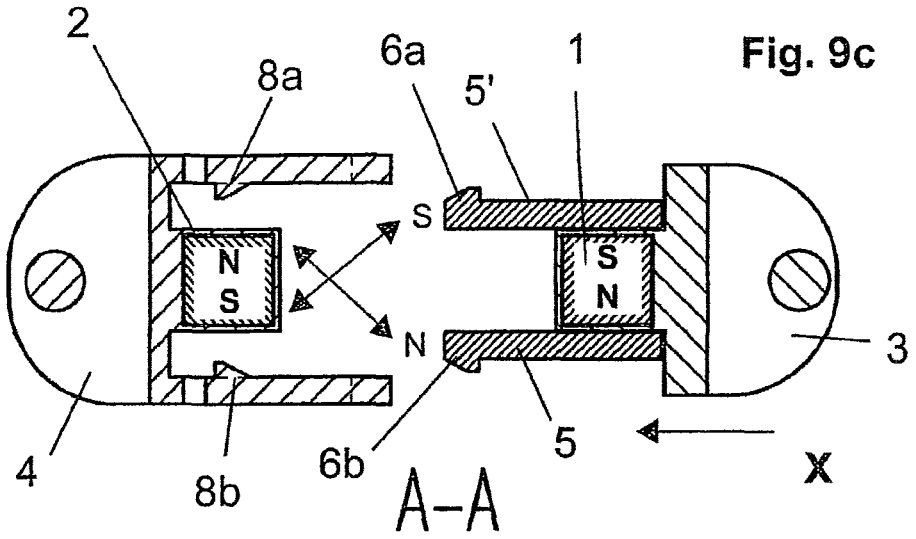
Fig. 9d
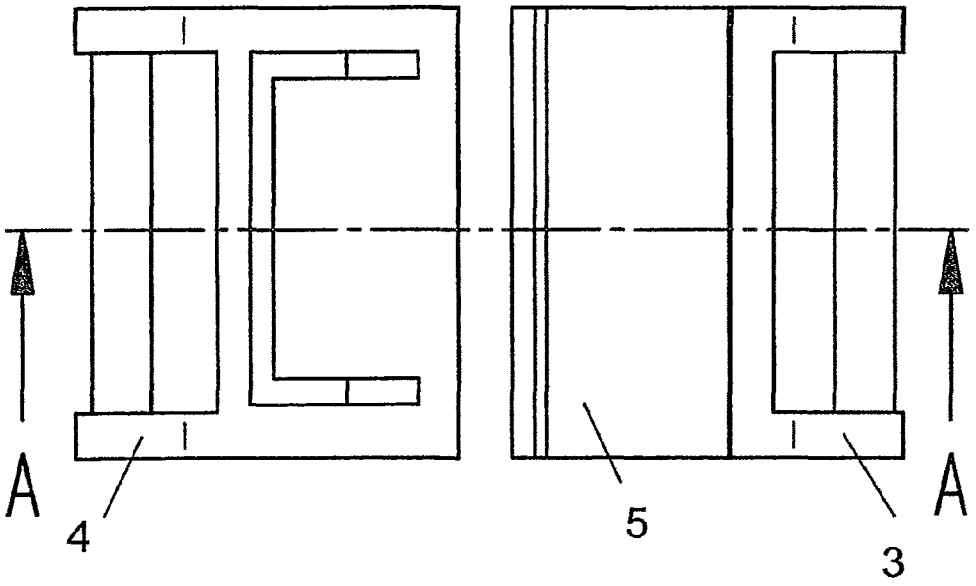

SHIELDED MAGNETIC PLUG-IN LOCK

CROSS-REFERENCE TO RELATED APPLICATION

This application is a National Phase Patent Application of International Patent Application No. PCT/DE2009/001007, filed on Jul. 17, 2009, which claims priority of German Patent Application No. 10 2008 033 546.0, filed on Jul. 17, 2008.

BACKGROUND OF THE INVENTION

Field of the Invention

The invention relates to a shielded magnetic plug-in lock that does not damage or negatively affect magnetically sensitive instruments or objects such for instance credit cards, pace makers, magnetic data memories or magnetic tapes, and in particular a magnetic plug-in lock, for which a connector is plugged-in to a connector receiving element and held therein by magnetic holding forces or additionally by means of mechanical engagement.

A specific group of such locks is characterized in that the two locking halves are plugged in a closing direction for closing, whereby the magnets arranged in the locking halves attract each other, but for opening the two locking halves are not again pulled apart suddenly opposite to the closing direction, but are moved gradually lateral from each other in an opening direction. Herewith a pleasant haptics is obtained, whereby haptics is to be understood as how the lock feels during opening and closing for the person actuating the lock. This property is a crucial criterion if a lock operated by hand is usable for practice that means a lock has to be closed and opened in a haptic pleasant manner.

In order to illustrate the problems of shielding a magnetic lock in an illustrated manner, only the magnets of such a lock are shown in the FIGS. 4*a*, 4*b*, that means the housing for the connector and the housing for the connector receiving element are not shown. FIG. 4*a* shows that north and south pole are opposite to each other so that a maximum attraction is guaranteed. In order to show the distribution of the magnetic field lines in a better way, the lock is not completely closed, that means the magnets are still slightly distanced from each other. It is shown that a part of the magnetic field lines continue in form of an arch of a circle outside of the magnets. This part of the magnetic field is effective on the outside of the plug-in lock that means outside and could damage the magnet field sensitive part of a credit card directly disposed thereon. Therefore, it must prevented, that this part of the magnetic field lines escapes.

The locking halves are moved towards each other during opening of the lock so that the magnets are moved apart from each other, see FIG. 4*b*. Further explanations are provided in the description of the embodiments of the invention.

In order to prevent an escape of magnetic field lines as shown in FIG. 4*a*, magneto-conductive plates can be employed. These magneto-conductive plates and their effect are shown in FIG. 5 and are already known from prior art. As can be seen from FIGS. 5*a* and 5*b*, almost none of the magnetic fields escape on the outsides of the lock neither in the closed status of the lock nor in case of an opened lock, what would be desirable for this lock. However, this type of shielding for locks according to FIG. 4 is not applicable. This has the following reason:

The magnetic arrangements according to FIG. 4 have the characteristic to automatically reset towards each other during a lateral movement. This characteristic is known from and is applied in case of some types of magnetic locks, for instance in order to improve opening haptics. This shall be explained by means of FIG. 4*b*: The arrows between the magnetic fields shifted towards each other symbolise the restoring forces. The arrows can also be regarded as stretched rubber bands, which attempt to again pull back the moved magnet 2 via magnet 1. Therefore it is understandable that during opening of such a magnetic lock a gradually increasing force has to be overcome through which a haptics is formed being comfortable for the human hand. The arrangement shown in FIG. 5 does, however, not have this restoring force. In so far, an arrangement according to FIG. 5 is on one hand very well suitable for above described magnetic plug-in locks in respect to their low magnetic scattering effect, on the other hand this arrangement is not suitable due to its missing restoring force. In so far, further possibilities for magnetic shielding had to be searched for. An internal developed, not published solution is shown in the FIGS. 3*a*, 3*b*. A magnetic arrangement according to FIG. 4 is used. A magnet is arranged in the connector and a second magnet is arranged in the connector receiving element. The connector is plugged into the connector receiving element in closing direction X, whereby the south pole of the connector magnet and the north pole of the connector receiving element magnet oppose each other in an attracting manner. The connector is moved laterally out of the connector receiving element for opening, so that the magnets are moved against each other.

Shielding plates 5, 5' were arranged in the connector receiving element in order to avoid magnetic field lines acting outwardly as shown in FIG. 4*a*. These means have to be shown as being suitable to shield the magnetic scattering lines outwardly in a sufficient manner. However, a new effect appeared in this construction which strongly impaired the haptics during plugging the connector. It was not possible to plug the connector in an easy manner, but rather the connector got stuck on the upper edge of the connector receiving element what was affected by a magnetic attraction. This has the following reasons: The upper edges of the shielding plates also continue along the lateral upper edges of the connector receiving element. The upper edges of the two shielding plates 5, 5' have the same polarity since they both are located in the scattering field of a north pole of the magnet of the connector receiving element. For this reason both upper edges are N-poled in the present example according to FIG. 3. If it is now being attempted to plug the connector manually into the connector receiving element, the connector is pulled either to the left or to the right lateral edge of the connector receiving element, since the south pole is in the front of the connector magnet and unlike poles attract each other.

In so far the operator has to concentrate strongly and has also to apply a certain force in order to plug the connector between these magnetic N-poles into the plug-in opening, what is being sensed as a very bad haptics.

SUMMARY OF THE INVENTION

It is therefore the object of the invention to provide a magnetic plug-in lock of the previously described kind, which has good magnetic shielding as well as a good haptic during closing and during opening.

A magnetic plug-in lock according an exemplary embodiment of the invention comprises a connector and a connector receiving element. A connector magnet is arranged in the connector and a magnet for the connector receiving element is arranged in the connector receiving element. The connector and the connector receiving element are designed such that the connector can be plugged into the front side of the connector receiving element for closing the magnetic plug-in lock. The direction into which the connector is moved while inserting is the closing direction X. The connector is moved laterally to this closing direction out of the connector receiving element for opening the magnetic plug-in lock, that means the opening direction is not opposite to the closing direction X.

The connector magnet and the magnet of the connector receiving element are magnetized according to the invention transversally to the closing direction X of the magnetic plug-in lock. Furthermore, the connector magnet and the magnet for the connector receiving element are positioned in the following manner in respect to the closing direction X: The north pole is located left and the south pole is located right in the connector magnet. In case of the magnet for the connector receiving element the poles are interchanged so that connector and connector receiving element attract each other. In other words, the connector magnet and the magnet for the connector receiving element face each other with an opposite polarity.

It is obvious for the person skilled in the art that due to this combination of features a lower magnetic attraction force is effected as if each of the opposing magnetic fields have only one magnet pole respectively, that means the magnets are polarized laterally to the closing direction X and therefore the attraction force is higher.

It has to be emphasized that for a person skilled in the art, who constructs a magnetic plug-in lock, there is no reason to select such a magnetizing direction since the disadvantages of this arrangement are known to him/her.

One or multiple shielding plates made of ferromagnetic material are furthermore part of the invention. These shielding plates cover as well as the connector magnets as well as the magnets for the connector receiving element so far that a sufficient shielding is guaranteed for the respective use. The person skilled in the art knows that these characteristics of the ferromagnetic material itself and its thickness influence the shielding properties of the shielding plates so that the person skilled in the art considers also the material and the thickness when determining the required size of the shielding plates. In so far, it is also not possible to exactly specify how large the shielding plate has to be designed.

This arrangement comprises in contrast to the previously described prior art a very pleasant haptic characteristic for the operator of the magnetic plug-in lock: If the connector is guided by hand in X direction near to the pulling area, said connector does not get any longer caught on the upper edge of the connector receiving element, but said connector is being centred by a magnetic self-centering into the optimal plug-in position. This effect is explained in the following:

The shielding plates are magnetically polarized by the magnet for the connector receiving element. Since the magnet for the connector receiving element is polarized transversally to the closing direction, the upper edges of the shielding plates are unlike polarised. Through this, the connector receives the above-mentioned tendency for self-centering, if said connector gets near to the plugging area of the connector receiving element. The magnetic force relations are further explained in more detail in the example.

Only the version with two shielding plates was described previously. The technical teaching of the pleasant, self-centering closing without accidental adherence of the connector at the upper edge of the shielding plate functions also only with one shielding plate on one side of the lock.

It is therefore to be observed that the problems described in case of the construction according to FIG. 3 do not occur in case of the invention. In so far the lock according to the invention has clearly improved closing haptics by simultaneously good shielding of the magnetic field.

The invention is further improved according to a further exemplary embodiment such that during closing in closing direction X a spring latching between connector and connector receiving element is closed by the magnetic attraction. The lock is then kept shut magnetically and mechanically. The connector is moved laterally to closing direction X for opening, whereby the spring latching is moved laterally for disengagement without that the latching springs have to be expanded by a force for opening. Due to the additional arrangement of the mechanical latching a lock is obtained with a stable mechanical locking, whereby the soft haptics is maintained.

While in the previously described improvement the springs of the spring latching do not have to be expanded during opening, the springs are expanded in case of a very similar improvement of the invention. For this reason, a force diverting slope is applied, which gradually opens the spring latching during opening by moving laterally to the closing direction X during the movement by expansion of the springs.

This embodiment requires a larger effort during opening, since the magnets have to be shared towards each other and additionally the latching spring has to be expanded. However this property can be of an advantage in case of locks, which are not allowed to be opened by an accident.

According to an exemplary embodiment of the invention the two lateral shielding plates are connected to one piece of plate. Herewith, the magnetic scattering can further be reduced and the assembly of the shielding plate is simplified. This is shown in an embodiment according to FIGS. 6*a*, 6*b*. This embodiment differs from the one shown in FIG. 1*a*, 1*b* only in that the shielding plates 5, 5' are combined to one singular, U-shaped shielding plate 5.

According to an exemplary embodiment of the invention also an additional mechanical spring latching lock is provided, in case of which the connector pushes aside a spring latching while plugging together until the connector engages. The improvement of the invention is that at least one section of a shielding plate is designed as a spring. This embodiment of the invention is in particular preferred, since the shielding plate has simultaneously the function of the spring. In so far this part has a double function.

BRIEF DESCRIPTION OF THE DRAWINGS

The invention is explained in the following by the means of an example and in comparison to the prior art and an internal example not being part of the invention.

FIGS. 2*a, b* show an embodiment of the invention in the closed status;

FIGS. 9*a-g* show an embodiment with shielding plates arranged at the connector;

DETAILED DESCRIPTION OF THE INVENTION

Figure 1A:
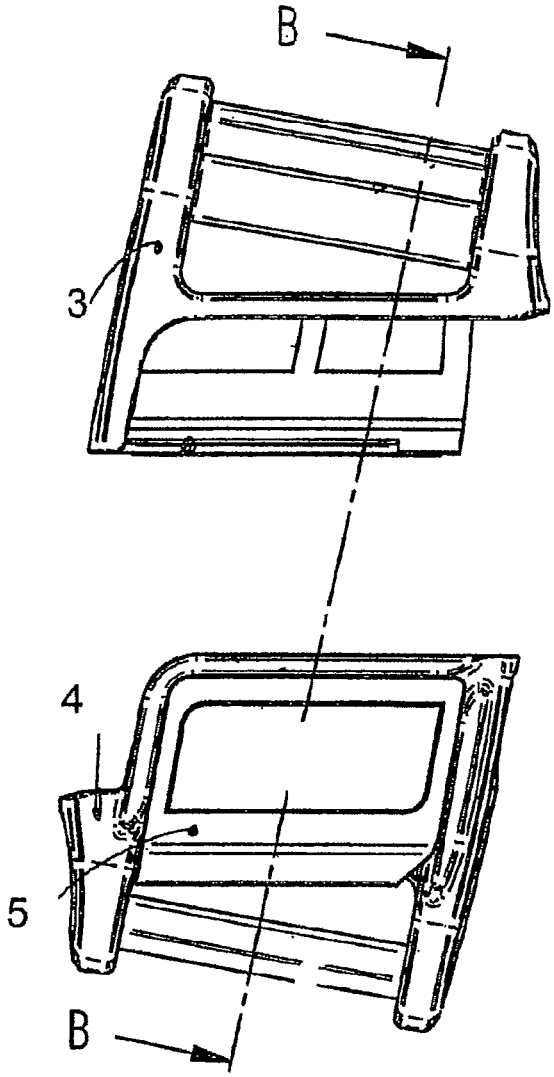
FIGS. 1*a, b* show an embodiment of the invention in the opened status, whereby the shielding plates are arranged at the connector receiving element.
Figure 1B:
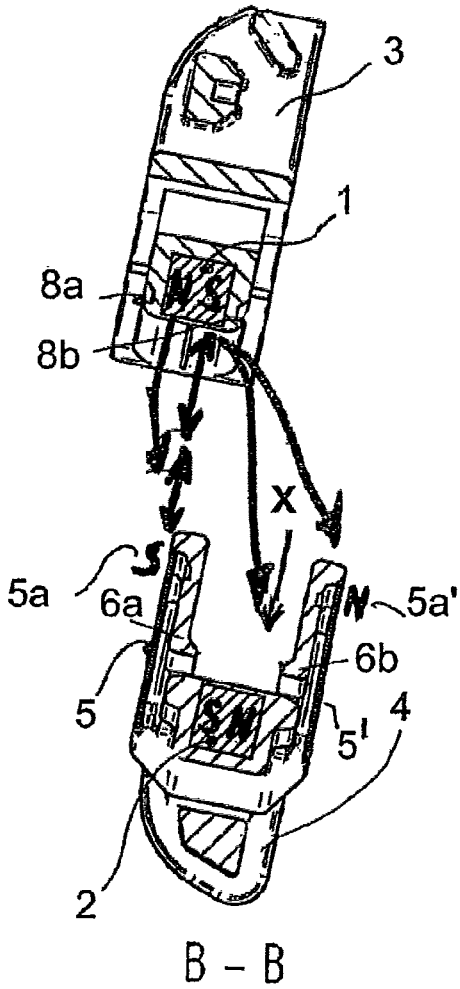

FIG. 1*a* shows the magnetic plug-in lock according to the invention in the front view and FIG. 1*b* shows a sectional view B-B. Rod-shaped magnets are designated with 1 and 2, which extend over the width of the magnetic plug-in lock shown in FIG. 1*a* and comprise in this example a square cross section. The magnetisation is designated with N for north pole and S for south pole. The magnetisation continues lateral to the closing direction X, along which the connector 3 is plugged into the connector receiving element 4, and thereby the spring latching engages from the latch noses 8*a*, 8*b* and the springy spring latch noses 6*a*, 6*b*. FIG. 2*a, b* show the plugged-in state, in which the connector 3 is plugged into the connector receiving element 4, whereby the magnets 1, 2 are located adjacent to each other in an unlike polarisation attracting each other.

Figures 3A, 3B:
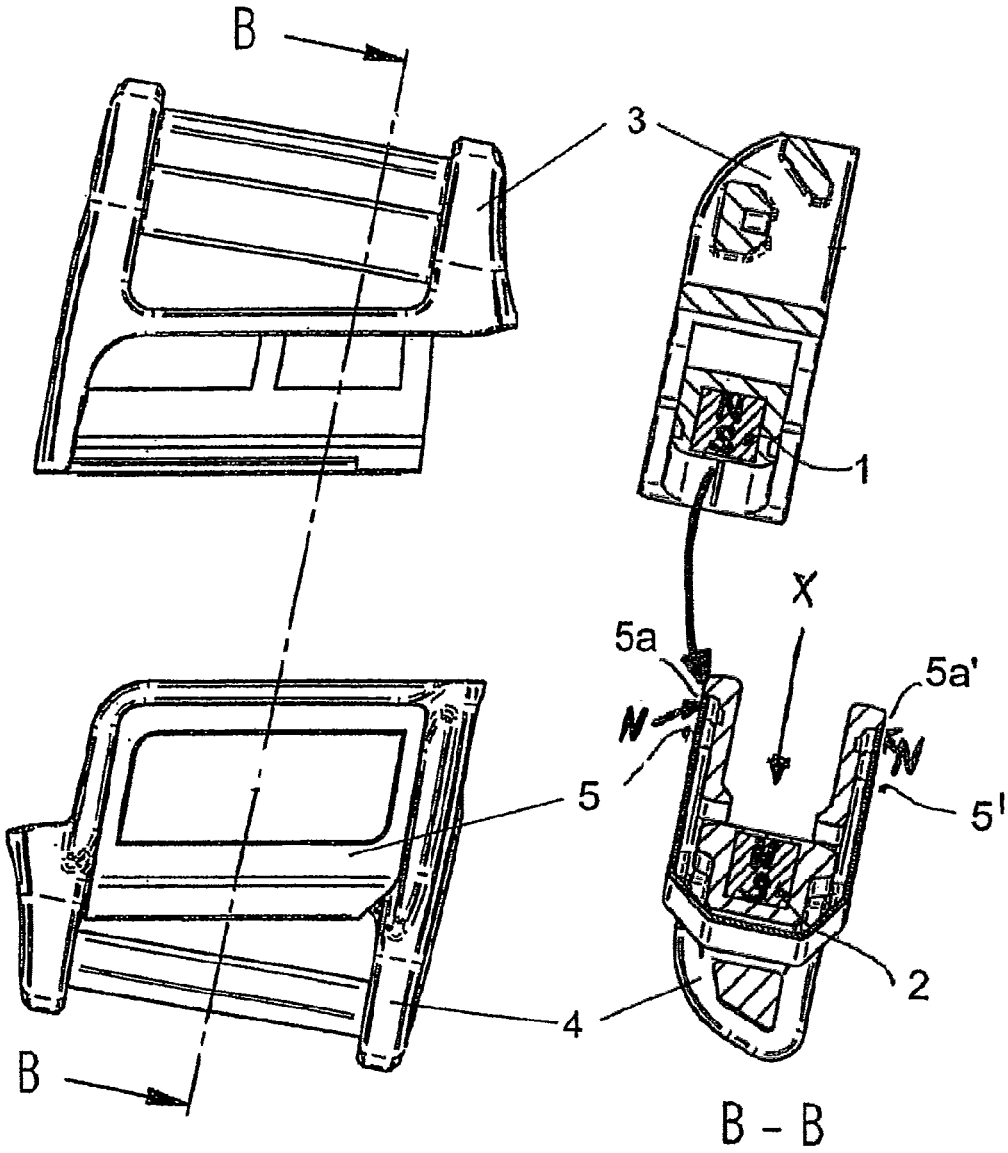
FIGS. 3*a, b* show an internal comparative example not being part of the invention.

The object solved by the invention shall be at first explained by the means of an internal comparative example according to FIGS. 3 *a, b* not being part of the invention. This magnetic plug-in lock is identical to the invention with the exception of one difference. The magnetisation of the magnet is in this case not transversal, but longitudinal to the closing direction, that means that the south pole of the connector magnet 1 located in the front of connector 3 meets while plugging in the north pole of the magnet 2 of the connector receiving element located in the front of the connector receiving element 4. On each side of the connector receiving element 4 a shielding plate 5, 5' with a thickness of 1 mm made of ferromagnetic material, in this example iron, which has a good magnetic conductivity is arranged. Due to the magnetic interaction with the magnet 2 of the connector receiving element the upper edges 5*a*, 5*b* of the shielding plates are polarised as north pole, respectively. If it is being attempted to plug-in the connector 3 into the connector receiving element 4, the south pole of the connector approaches the upper edges 5*a*, 5*b* of the shielding plate 5 being magnetised as north pole. In dependency from which side the approach takes place, the connector adheres to this side. The connector is pulled in FIG. 3*b* along the arrow direction to the left upper edge of the connector receiving element. The person using the lock has to suddenly rip off again the connector and has to try again to insert the connector in a centrical manner. This inadequate haptic is removed in the invention, what is being explained by the means of FIG. 1*b*. Due to the magnetic interaction with the magnet of the connector receiving element the upper edges 5*a*, 5*b* of the shielding plate 5 are polarised differently. By the means of the drawn arrows, which symbolise the attraction and repulsion, it is recognisable that the magnetic forces of the upper edges of the shielding plates and the magnet of the connector receiving element exert a self-centering effect onto the connector.

Figure 4A:
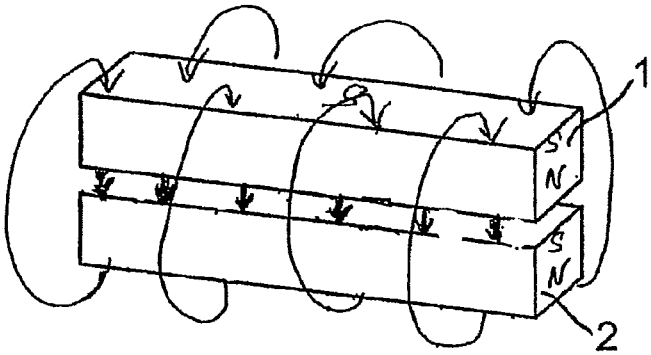
FIGS. 4*a*, 4*b* show two magnets, which are not used in the comparative example according to FIG. 3 not being part of the invention.
Figure 4B:
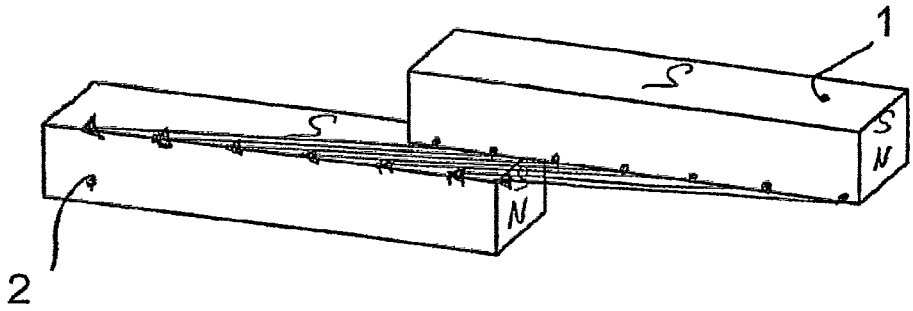
Fig. 4b Prior art

FIG. 4*a* shows in a perspective illustration two magnets 1, 2 which are used in a comparative example according to FIG. 3 not being part of the invention. The arrows indicate the escaping magnetic field lines, which have to be shielded. FIG. 4*b* shows the shifted state, that means in which the lock is opened. The arrows symbolise the restoring forces between the shifted magnets, that means the magnets are automatically reset into the position 4*a*, if the friction forces between the magnets are sufficiently small.

Figure 5A:
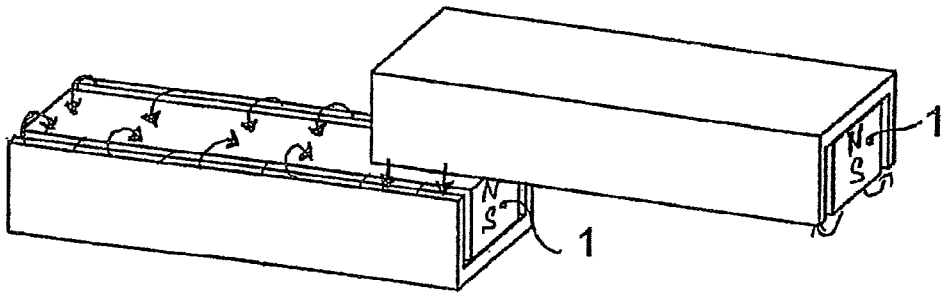
FIGS. 5*a, b* show two shielded magnets for explanation, which cannot be used in the invention.
Figure 5B:
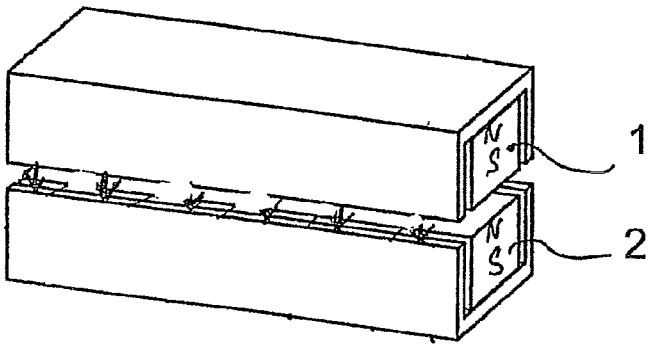

FIGS. 5 *a, b* show two shielded magnets, which cannot be used in the invention, since these constructions do not comprise the required restoring forces.

Figure 6A:
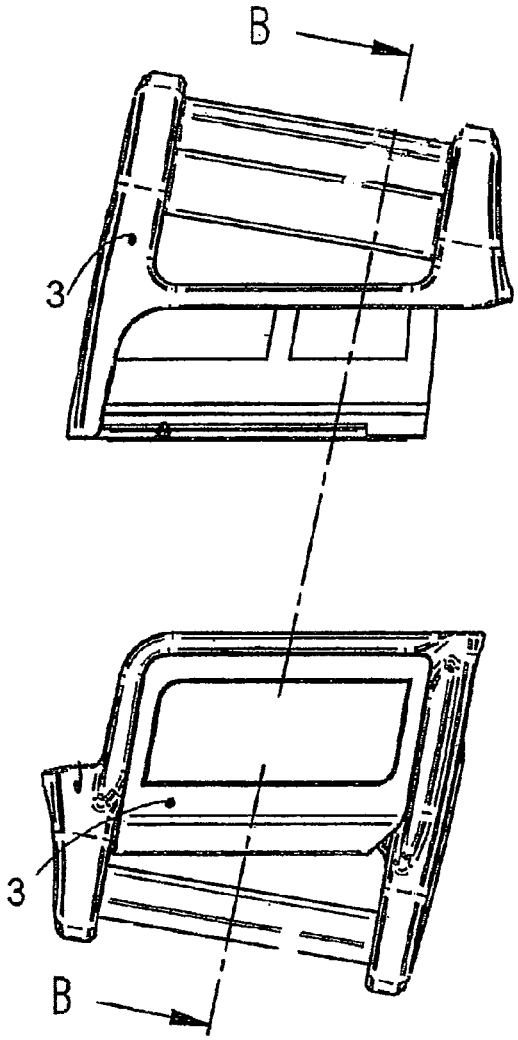
FIGS. 6*a, b* show an embodiment of the invention with shielding plates being connected in a U-shaped manner.
Figure 6B:
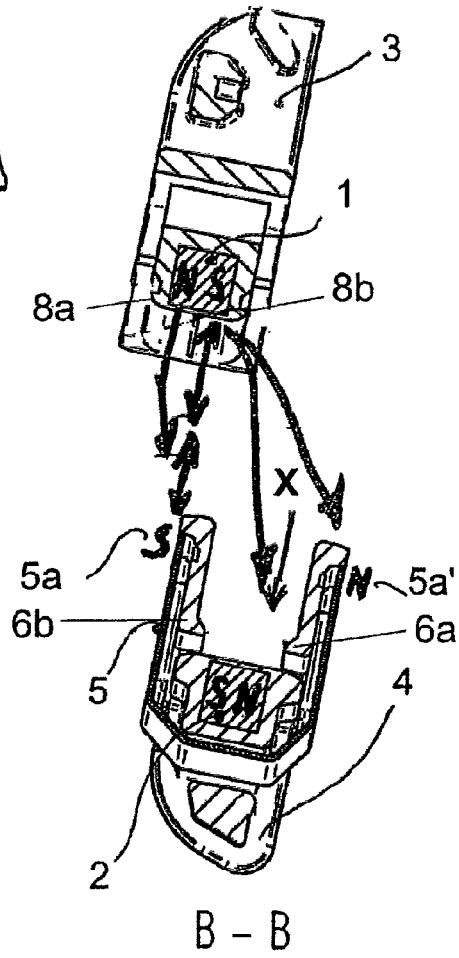

FIGS. 6 *a, b* show an embodiment with a U-shaped shielding plate 5 formed in one piece according to claim 2. This embodiment is to be mounted in a particular simple manner and additionally shields magnetically the lock on the lower side. This embodiment differs from the embodiment shown in FIGS. 1*a*, 1*b* only such that the shielding plates 5, 5' are combined to one singular U-shaped shielding plate 5.

Figures 7A, 7B:
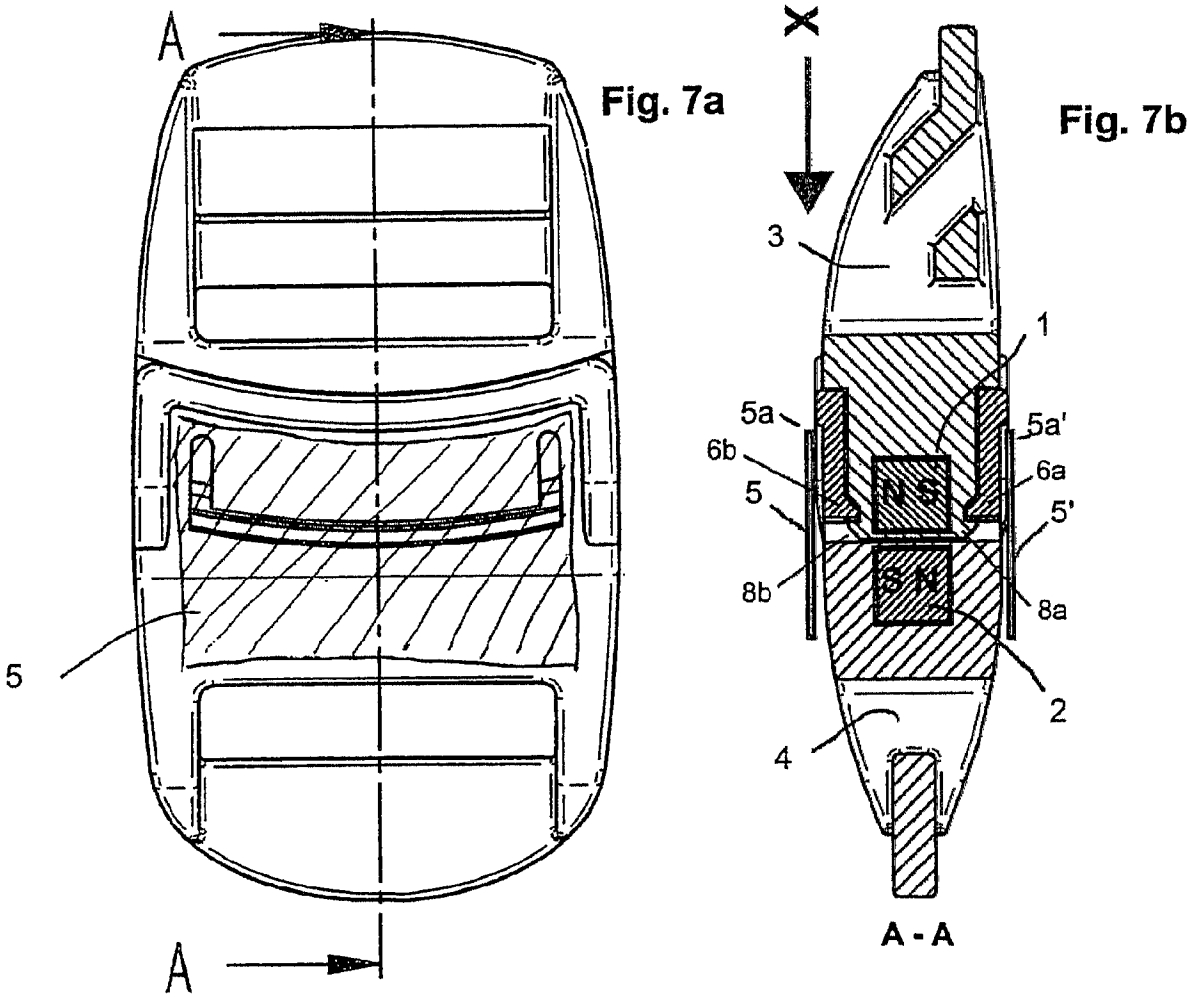
FIGS. 7*a, b* show an embodiment of the invention with semi-circular arched opening direction to the right or left.
Figure 8A:
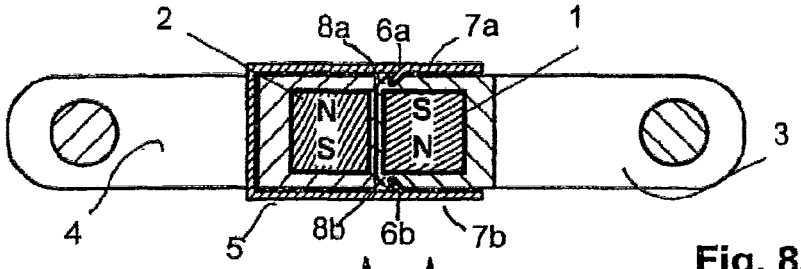
FIGS. 8*a, b, c, d* show an embodiment with springy shielding plate.
Figure 8B:
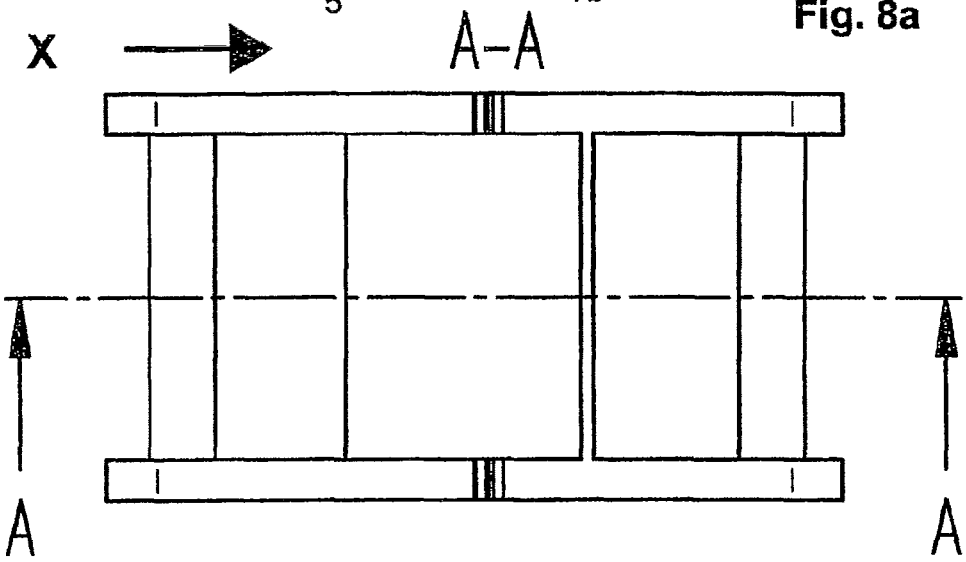
Figure 8C:
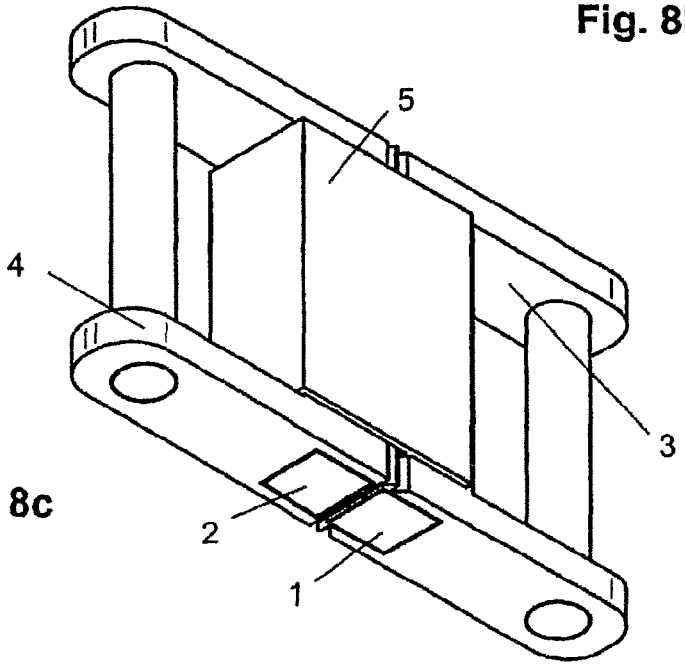
Figure 8D:
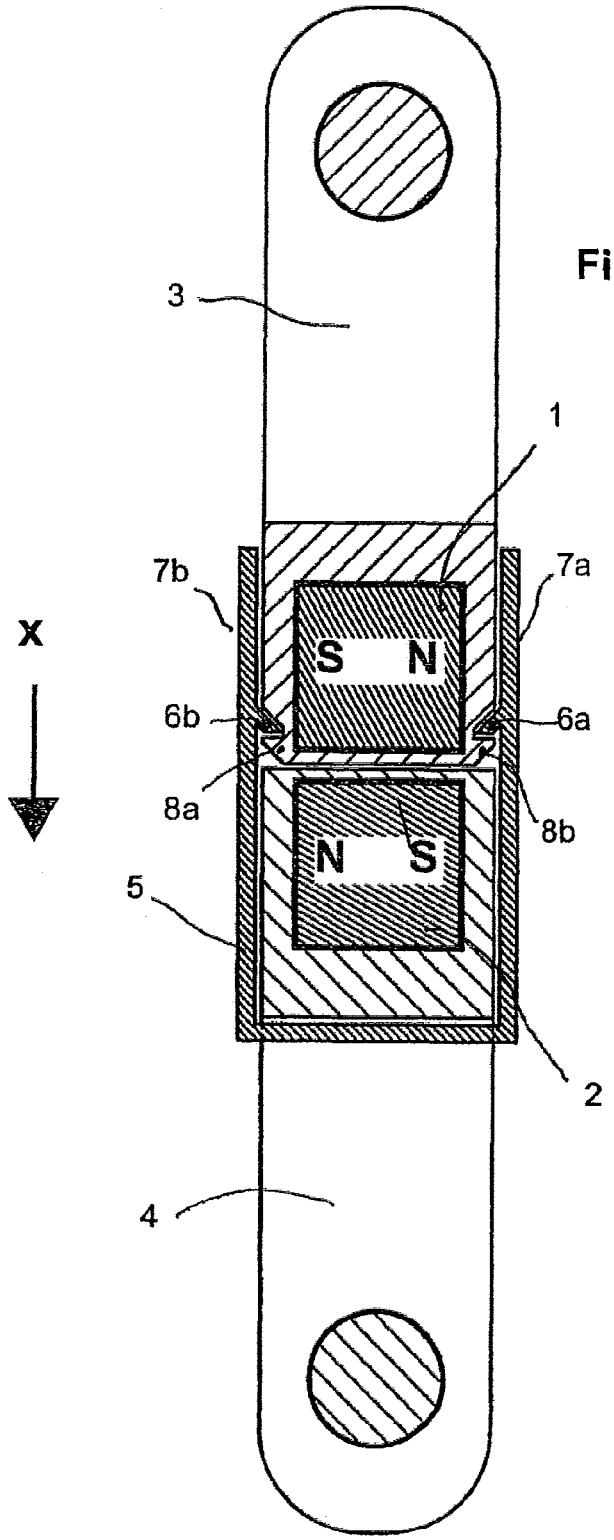

FIGS. 7 *a, b* show a magnetic plug-in lock according to the invention in which the connector is pivoted for opening arc-like laterally to the right or the left. The shielding plates 5, 5' cover the magnets 1, 2 so far that the magnetic plug-in lock is shielded magnetically on the outer sides. The magnets 1, 2 are magnetised transversally to the closing direction X. The function is identical to the embodiment according to FIGS. 1 *a, b* with the exception of the varying opening directions so that these Figures are referenced for further explanation.

FIGS. 8 *a, b, c, d* show a magnetic plug-in handle in different views. FIG. 8*d* is an enlargement of FIG. 8*a*. The shielding plate 5 has here additionally to the shielding a further function: Said shielding plate is simultaneously the spring of a spring latching lock, formed by the springy shielding plate wings 7*a*, 7*b*, the latching noses 6*a*, 6*b* connected to the shielding plate wings 7*a*, 7*b* and the latching noses 8*a*, 8*b* of the connector. The shielding plate has therefore a double function, so that the size of the connector is minimized. The connectors 3 and the connector receiving element 4 are pulled together during engaging by the magnets 1, 2 until the latching noses 6*a*, 6*b* and 8*a*, 8*b* dodge in a springy manner and engage finally in an engagement. The magnetic plug-in handle is then moved laterally to the closing direction X for opening.

In FIGS. 1*a*, 1*b*, 2*a*, 2*b*, 7*a*, 7*b*, 8*a-d*, 9*a-g*, 10*a-e* embodiments are shown which comprise a spring latching of the latching noses 8*a*, 8*b* and the spring latching noses 6*a*, 6*b*. The magnetic force tightens the spring latching automatically for closing, whereby the spring latching noses 6*a*, 6*b* dodge in a springy manner. The spring latching is avoided during opening laterally to the closing direction X, that means the spring latching noses 6*a*, 6*b* are not expanded. The lock is then also easy to open, as if no spring latching would have been installed. The lock is only hindered by the lateral holding force of the magnets from opening that means by the restoring forces shown and explained in FIG. 4B against the shift. The magnets are gradually sheared off from each other during opening of the lock according to the invention in a haptic pleasant manner.

Figure 11A:
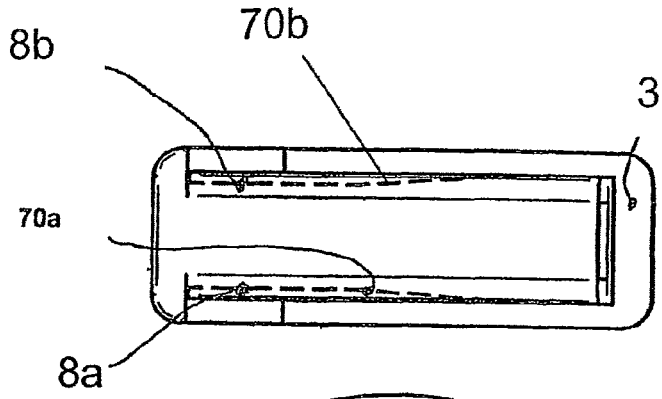
FIGS. 11*a-g* show an embodiment with opening of the spring latching by the means of force diverting slope.
Figure 11B:
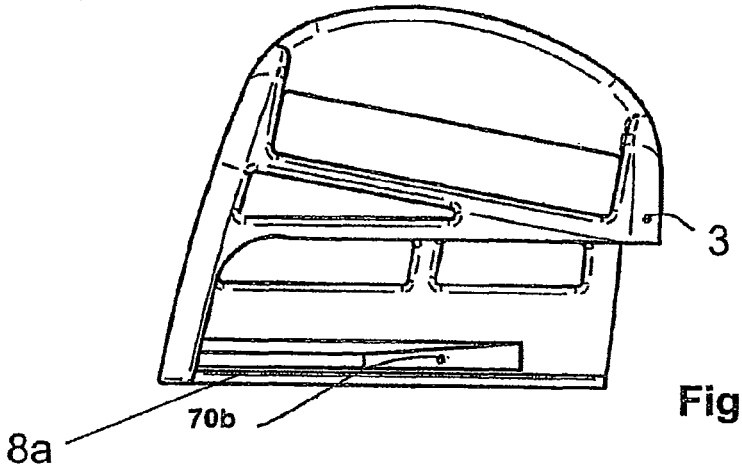
Figure 11C:
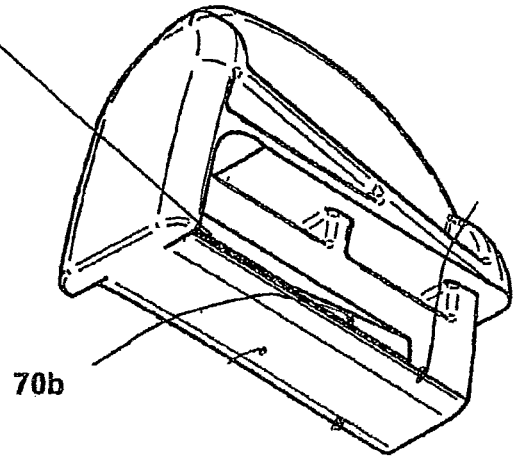
Figure 11D:
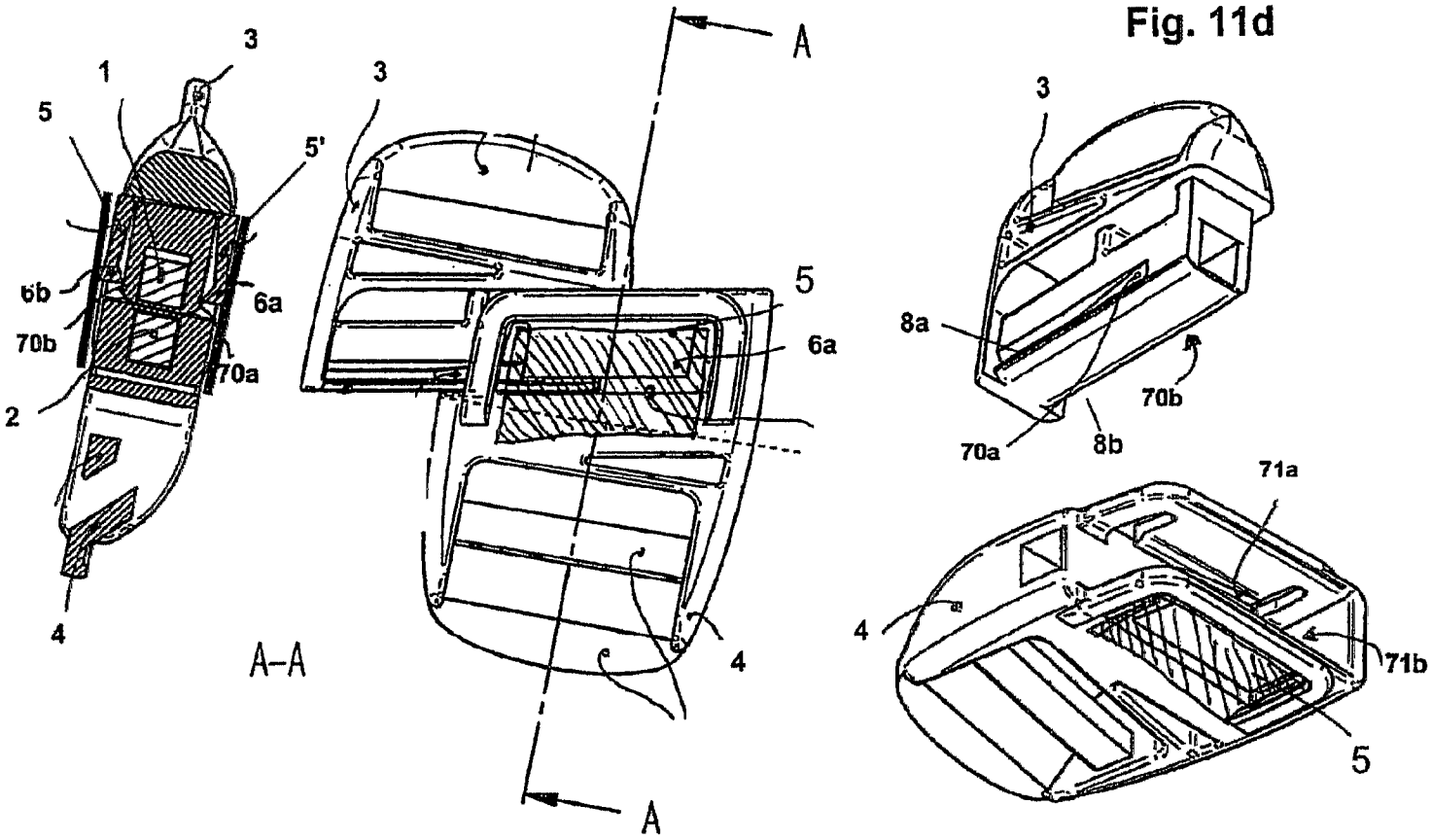
Figure 11E:
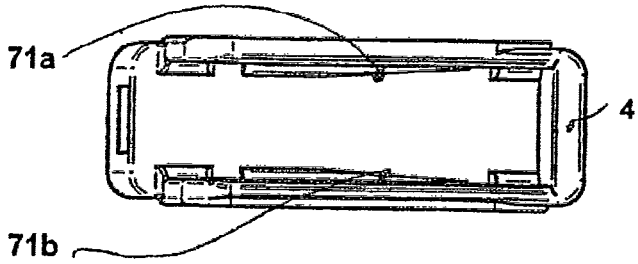
Figure 11F:
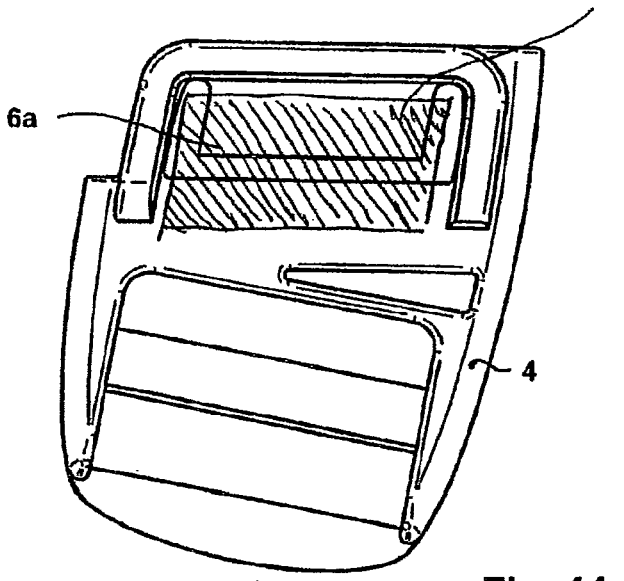
Figure 11G:
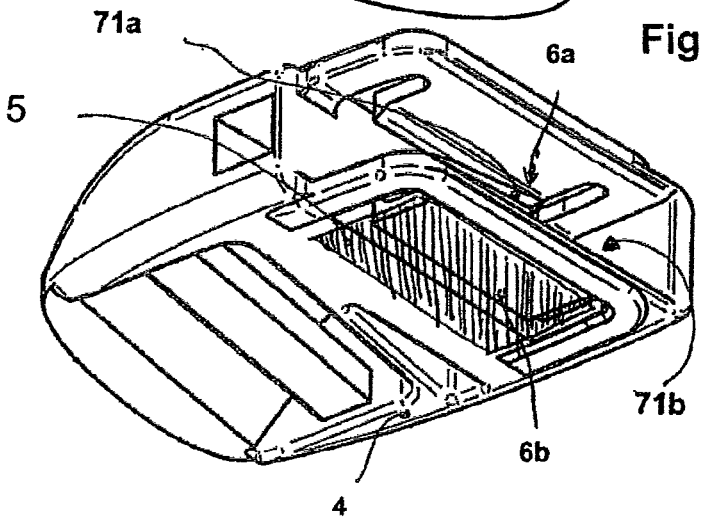

A closely related embodiment is shown alternatively in the FIGS. 11*a-g*, in which during opening by a lateral shift the spring latching noses 6A, 6B are pushed gradually by force diverting slopes 70*a*, 70*b* so far until the latching noses 8*a*, 8*b* and the spring latching noses 6*a*, 6*b* are disengaged. This is in particular of an advantage if a pre-determined securing against unintended opening shall be guaranteed. FIGS. 11A, B, C show in view from below, side view and perspective view the connector 3, at the lower edges thereof the latching noses 8*a*, 8*b* and the force diverting slopes 70*a*, 70*b* are located. FIGS. 11*e-g* show in view from below, side view and perspective view the connector receiving element 4 with the spring latching noses 6*a*, 6*b* and two further force diverting slopes 71*a*, 71*b*. In the Drawing 11*d* the shifted opening state is depicted in the left sectional view, in which the force diverting slopes 70*a*, 70*b* have expanded the spring latching noses 6*a*, 6*b* so far that the latching is being disengaged. Simultaneously, the magnets 1, 2 were gradually sheared from each other that means moved from each other. The shielding plates 5, 5' are arranged at the connector receiving element. They cover the magnets 1, 2 in the closed state so far that the lock is shielded as much as required.

A lock is also provided without the spring latching which is to be closed in a haptic pleasant manner, as well as to be opened in a pleasant manner, which is shielded by the shielding plates.

Figure 9A:
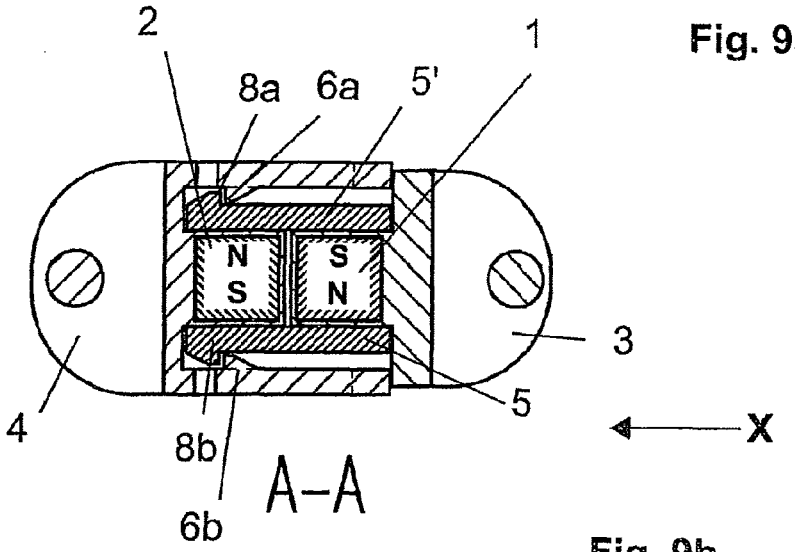
Figure 9B:
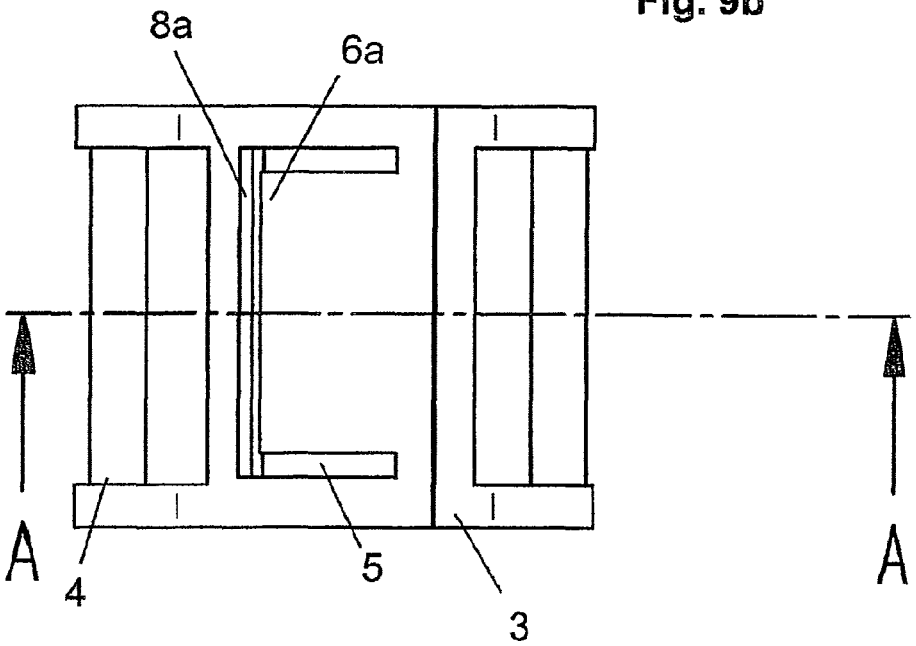
Figure 9E:
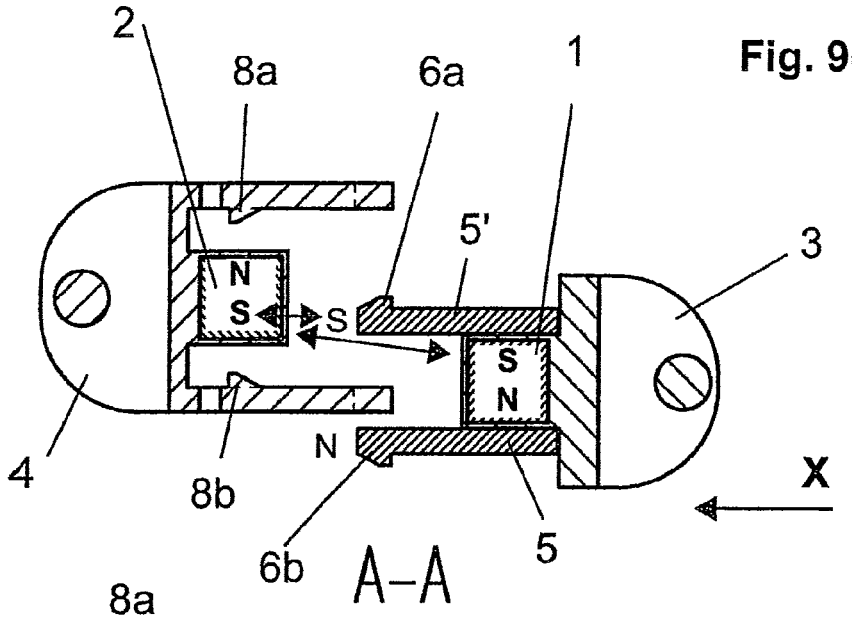
Figure 9F:
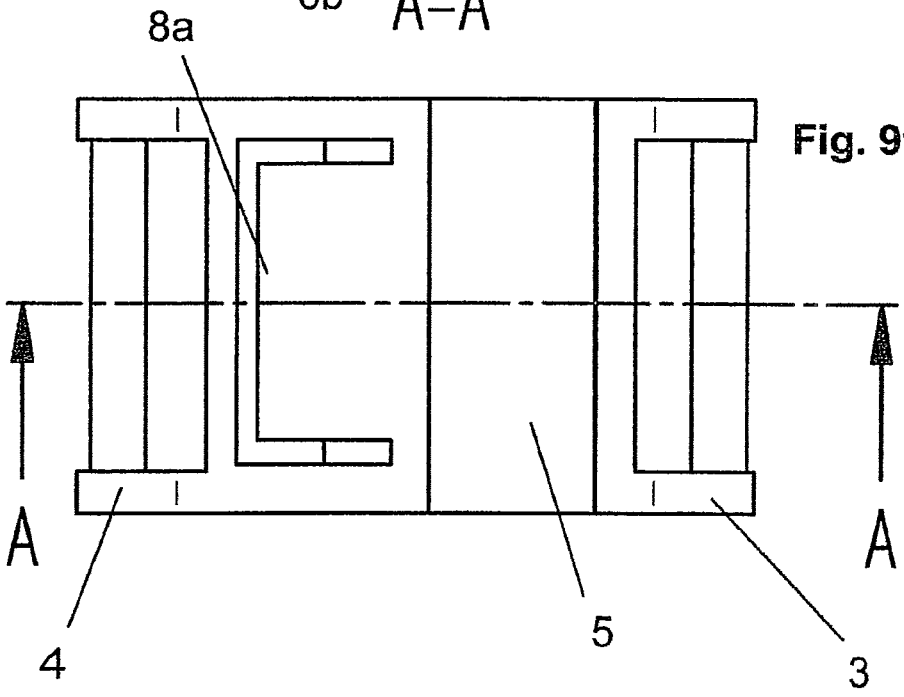
Figure 9G:
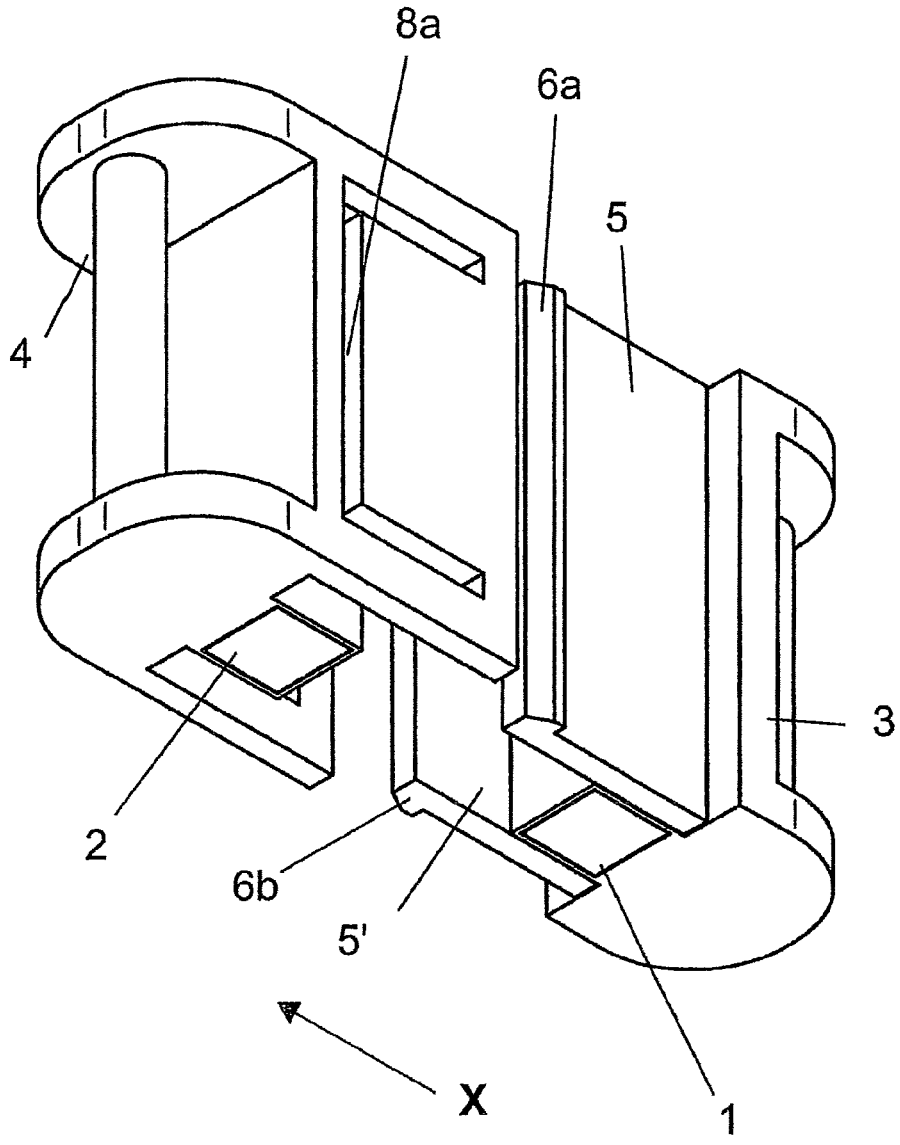

FIGS. 9*a-g* show an embodiment, in which two shielding plates 5, 5' are arranged at the connector. FIG. 9*a* shows the closed state, in which the shielding plates cover the magnets so far that the connector is shielded as much as required. FIG. 9*c* shows the opened state shortly before closing. Here, the rejecting forces between the front edges of the shielding plates 5, 5', which are polarized north (N) and south (S), and the north and south pole of the magnet 2 of the two of the connector receiving elements are drawn as arrows. These contribute beside the present attracting forces to the self-centering of connector and connector receiving element. In FIG. 9*e* an undesired position is drawn in which the connector and the connector receiving element are interlocked in an unfavourable manner. Due to the magnetisation continuing transversally to the closing direction X according to the invention and therefore accompanied polarisation of the frontal edges of the shielding plates 5, 5' rejection forces are obtained in this unfavourable position, that means the connector cannot interlock there and the connector centres itself in the connector receiving element. FIG. 9*g* shows the opened lock in a perspective view. As described above a spring latching consists between the latching noses 8*a*, 8*b* and the spring latching noses 6*a*, 6*b*.

Figure 10A:
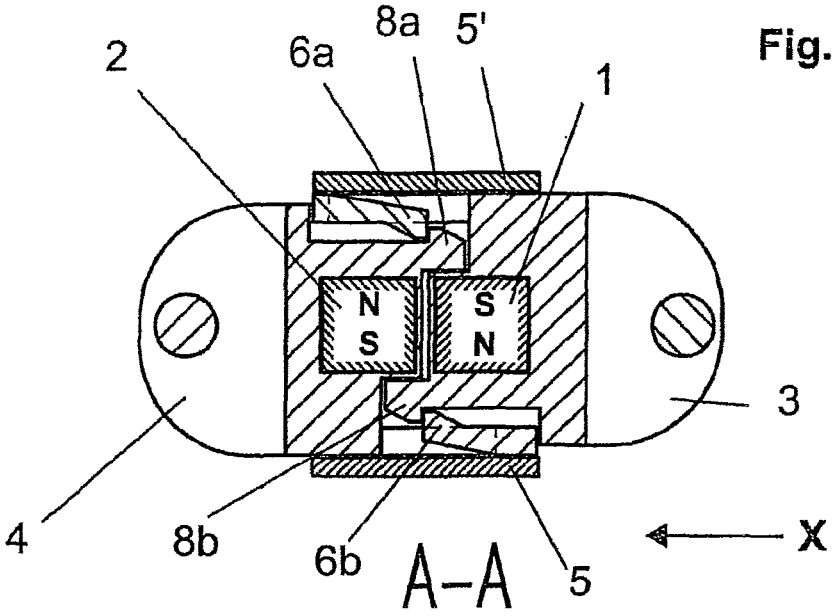
FIGS. 10*a-e* show an embodiment with a shielding plate arranged at the connector and at the connector receiving element.
Figure 10B:
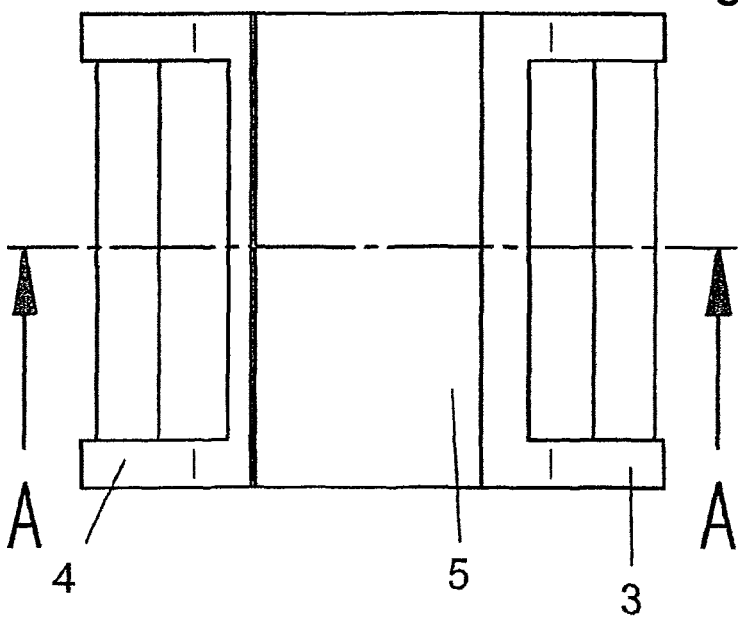
Figure 10C:
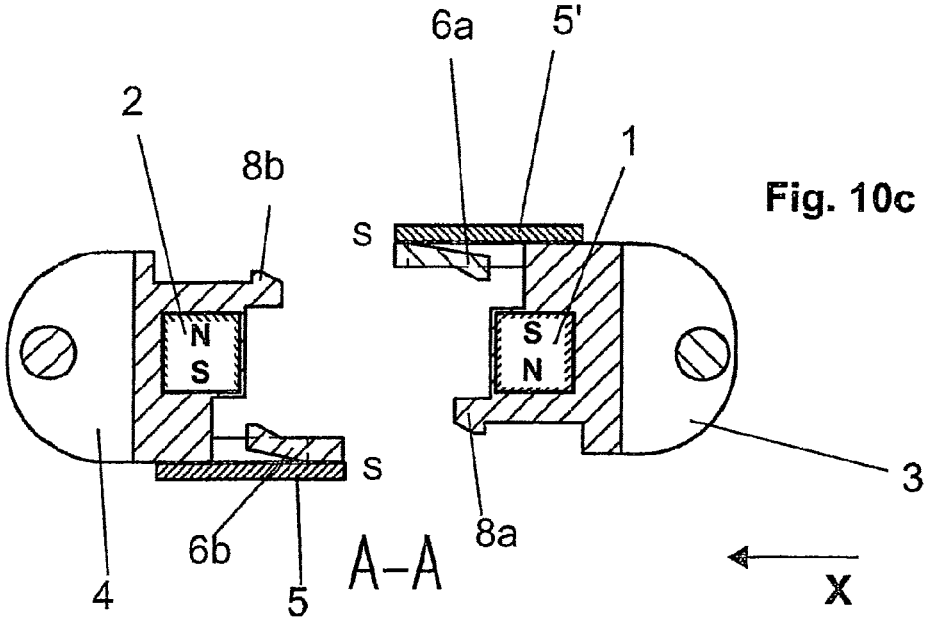
Figure 10D:
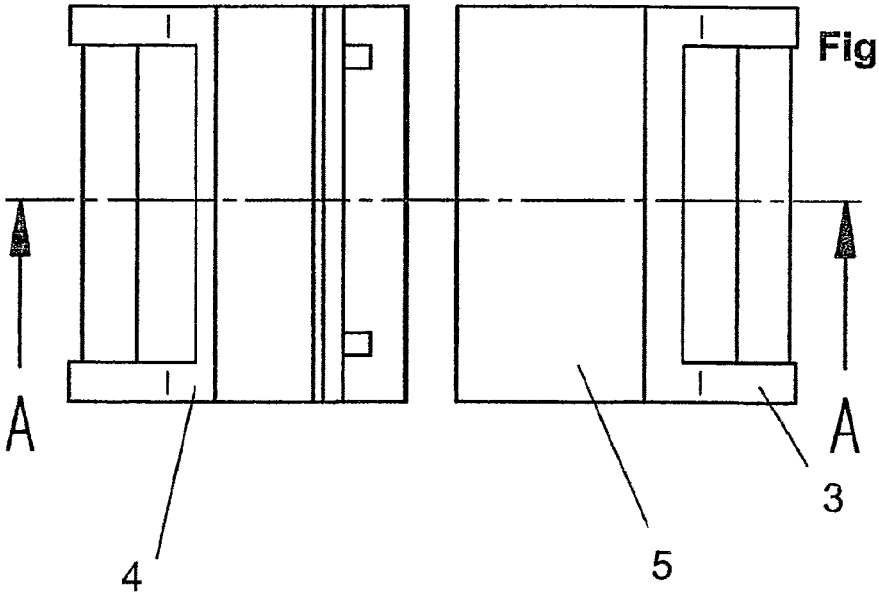
Figure 10E:
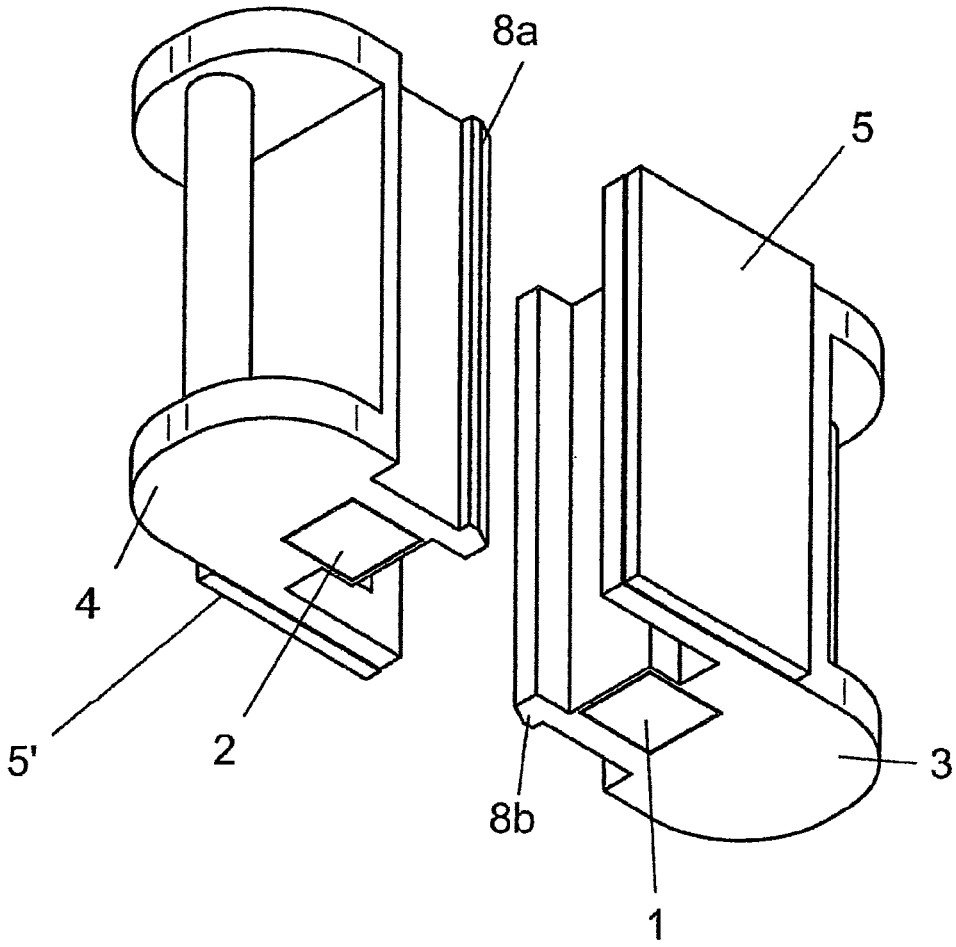

In the embodiment according to FIGS. 10*a-e* a respective shielding plate is provided at the connector 3 as well as at the connector receiving element 4. In the closed state according to FIG. 10*a* said plates cover the magnets 1, 2 as much as necessary for a sufficient shielding. Connector and connector receiving element are identical in construction—this is of an advantage since only one part has to be produced. The polarisation of the magnets according to the invention also provides here that the lock closes reliably in a self-centering manner. FIG. 10*c* shows the open state and 10*e* a perspective view of the opened lock.

It is obvious for a person skilled in the art that a number of shielded magnetic locks can be built according to the technical teaching, whereby the moving direction of the modules towards each other during opening can be also a tilting or a rotation. An optional mechanical latching lock can be either lateral bypassed or the latching springs can be gradually pushed open during the shifting. Furthermore, the U-shaped shielding plate can also be part of a mechanical latching lock. This lock can be designed as a plug-in handle with belt connections, said lock can be connected as a pocket lock on one side or on both sides tightly to the cover or bottom of the pocket for instance by welding. Said lock can be integrated into suitcases or other containers. The listing of applications however does not restrict the applicability of the invention.

The invention claimed is:

1. A magnetic plug-in lock with a connector and a connector receiving element, whereby a connector magnet is provided in the connector and a magnet for the connector receiving element is provided in the connector receiving element, the connector and the connector receiving element are designed such that the connector can be plugged in the front side in a closing direction X into the connector receiving element for closing and the connector can be moved lateral to the closing direction X out of the connector receiving element for opening, the connector magnet and the magnet for the connector receiving element are magnetized transversely to the closing direction X and the connector magnet and the magnet for the connector receiving element face each other with opposing polarity and at least one shielding plate consisting of a ferro-magnetic material is provided on the connector or connector receiving element, whereby the shielding plate covers the connector magnet as well as the magnet for the connector receiving element, and wherein the ferro-magnetic material and the thickness of the shielding plate are selected such that magnetic shielding sufficient for a pre-determined use is obtained.

2. The magnetic plug-in log according to claim 1, wherein a spring latching is provided at the connector and at the connector receiving element such that during plug-in of the connector into the connector receiving element the magnetic force between the magnets effects that the spring latching automatically engages and during opening the spring latching is moved laterally for disengagement by moving the connector lateral to the closing direction X or during opening by moving the connector lateral to the closing direction X the spring latching is gradually opened during the movement by means of a force diverting slope.

3. The magnetic plug-in log according to claim 1, wherein two shielding plates are connected in one piece to a plate.

4. The magnetic plug-in lock according to claim 1, wherein a mechanic spring latching locking is provided in which the connector during insertion presses a spring latching aside until the connector engages, whereby at least a section of a shielding plate is formed as a spring.

* * * * *

UNITED STATES PATENT AND TRADEMARK OFFICE

CERTIFICATE OF CORRECTION

PATENT NO. : 8,464,403 B2
APPLICATION NO. : 13/003825
DATED : June 18, 2013
INVENTOR(S) : Joachim Fiedler It is certified that error appears in the above-identified patent and that said Letters Patent is hereby corrected as shown below:

In the Claims

Column 8, Line 33, Claim 2, delete “log” and insert -- lock --

Column 8, Line 47, Claim 3, delete “log” and insert -- lock --

Signed and Sealed this
Fifth Day of November, 2013

Teresa Stanek Rea

Teresa Stanek Rea
*Deputy Director of the United States Patent and Trademark Office*

UNITED STATES PATENT AND TRADEMARK OFFICE

CERTIFICATE OF CORRECTION

PATENT NO. : 8,464,403 B2
APPLICATION NO. : 13/003825
DATED : June 18, 2013
INVENTOR(S) : Joachim Fiedler It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 225 days.

Signed and Sealed this
Eighth Day of September, 2015

Michelle K. Lee

Michelle K. Lee
*Director of the United States Patent and Trademark Office*